US009754532B2

(12) United States Patent
Park et al.

(10) Patent No.: US 9,754,532 B2
(45) Date of Patent: Sep. 5, 2017

(54) PIXEL REPAIR CIRCUIT AND ORGANIC LIGHT-EMITTING DIODE (OLED) DISPLAY HAVING THE SAME

(71) Applicant: Samsung Display Co., Ltd., Yongin, Gyeonggi-do (KR)

(72) Inventors: Kyong-Tae Park, Suwon-si (KR); Tae-Gon Kim, Cheonan-si (KR); Dong-Yoon So, Asan-si (KR); Sung-Ho Cho, Seoul (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 265 days.

(21) Appl. No.: 14/562,337

(22) Filed: Dec. 5, 2014

(65) Prior Publication Data

US 2015/0348466 A1 Dec. 3, 2015

(30) Foreign Application Priority Data

May 27, 2014 (KR) ..... 10-2014-0063640

(51) Int. Cl.
*G09G 5/00* (2006.01)
*G09G 3/3233* (2016.01)

(52) U.S. Cl.
CPC ... *G09G 3/3233* (2013.01); *G09G 2300/0413* (2013.01); *G09G 2300/0819* (2013.01); *G09G 2300/0861* (2013.01); *G09G 2310/0251* (2013.01); *G09G 2320/0209* (2013.01); *G09G 2320/0233* (2013.01); *G09G 2320/043* (2013.01); *G09G 2330/08* (2013.01)

(58) Field of Classification Search
CPC ..... G09G 2330/08; G09G 2330/10; G09G 2330/12
USPC ..... 345/690, 205
See application file for complete search history.

(56) References Cited

U.S. PATENT DOCUMENTS

2004/0183791 A1* 9/2004 Yoshida ..... G09G 3/006 345/204
2008/0068364 A1 3/2008 Park et al.
2015/0243214 A1* 8/2015 Jeong ..... G09G 3/3233 345/214

FOREIGN PATENT DOCUMENTS

KR 10-2004-0025344 A 3/2004
KR 10-2008-0022718 A 3/2008
KR 10-2008-0024278 A 3/2008
(Continued)

*Primary Examiner* — Gustavo Polo
(74) *Attorney, Agent, or Firm* — Knobbe Martens Olson & Bear, LLP

(57) ABSTRACT

A pixel repair circuit and organic light-emitting diode (OLED) display having the same are disclosed. In one aspect, the pixel repair circuit includes an emission controller configured to control the emission current and a repair line initialization unit configured to initialize the repair line. The pixel repair circuit further includes a current mirror unit configured to provide a mirror current of the emission current to the repair line initialization unit, wherein the current mirror unit is connected between a power supply voltage and the emission controller. The pixel repair circuit also includes a first emission switch configured to control an electrical connection between the emission controller and the current mirror unit based on an emission control signal and a second emission switch configured to control an electrical connection between the emission controller and the repair line based on the emission control signal.

20 Claims, 9 Drawing Sheets

(56) References Cited

FOREIGN PATENT DOCUMENTS

| | | | |
|---|---|---|---|
| KR | 10-2015-0114115 | A | 10/2015 |
| KR | 10-2015-0117358 | A | 10/2015 |

* cited by examiner

PIXEL REPAIR CIRCUIT AND ORGANIC LIGHT-EMITTING DIODE (OLED) DISPLAY HAVING THE SAME

INCORPORATION BY REFERENCE TO ANY PRIORITY APPLICATIONS

This application claims priority to and the benefit of Korean Patent Application No. 10-2014-0063640, filed on May 27, 2014 in the Korean Intellectual Property Office (KIPO), the entire disclosure of which is hereby incorporated by reference.

BACKGROUND

Field

The described technology generally relates to display devices, and more particularly, to pixel repair circuits and organic light-emitting diode (OLED) displays having the same.

Description of the Related Technology

Organic light-emitting diode (OLED) displays can display information such as images and characters by emitting light generated from an organic layer. This light is generated in the organic layer via the combination of holes supplied from an anode and electrons supplied from a cathode. OLED displays have advantages over traditional displays such as low power consumption, wide viewing angles, fast response times, stability at low temperatures, etc.

SUMMARY OF CERTAIN INVENTIVE ASPECTS

One inventive aspect is a pixel repair circuit having a repair line initialization unit.

Another aspect is an OLED display having the pixel repair circuit.

Another aspect is a pixel repair circuit comprising an emission control unit configured to control the emission current provided to the OLED through the repair line based on a scan signal and a repair data signal, a repair line initialization unit configured to initialize the repair line, the repair line initialization unit being connected to a first node between the repair line and the emission control unit, a current mirror unit configured to provide a mirror current of the emission current to the repair line initialization unit, the current mirror unit being connected between a power supply voltage and the emission control unit, a first emission switch configured to control an electrical connection operation between the emission control unit and the current mirror unit based on an emission control signal, and a second emission switch configured to control an electrical connection operation between the emission control unit and the repair line based on the emission control signal.

In example embodiments, the current mirror unit may include a first transistor having a first terminal connected to the power supply voltage, a second terminal connected to the first emission switch, and a gate terminal connected to the second terminal and configured to provide the emission current to the repair line, and a second transistor having a gate terminal connected to the gate terminal of the first transistor, a first terminal connected to the power supply voltage, and a second terminal connected to the repair line initialization unit and configured to provide the mirror current to the repair line initialization unit.

In example embodiments, the emission current and the mirror current may be generated when the first emission switch and the second emission switch are turned on.

In example embodiments, the repair line initialization unit may include a third transistor having a gate terminal that receives a gate initializing signal and a first terminal that receives a direct current (DC) voltage, and a fourth transistor having a gate terminal connected to a second terminal of the third transistor, a first terminal that receives a repair line initializing voltage, and a second terminal connected to the first node.

In example embodiments, the third transistor may be configured to apply the direct current voltage to the gate terminal of the fourth transistor in a turn-on period of the gate initializing signal. The fourth transistor may be configured to initialize the repair line while the fourth transistor is turned on as the direct current voltage is applied to the gate terminal of the fourth transistor.

In example embodiments, the mirror current may be provided to the gate terminal of the fourth transistor.

In example embodiments, the fourth transistor may be rapidly turned off as the mirror current increases.

In example embodiments, the repair line initialization unit may further include a hold capacitor connected between the power supply voltage and the gate terminal of the fourth transistor.

In example embodiments, the emission control unit may include a fifth transistor having a gate terminal that receives the scan signal and a first terminal that receives the repair data signal, and a driving transistor having a gate terminal connected to a second node that receives a driving voltage, a first terminal connected to the second terminal of the first transistor, and a second terminal connected to the second emission switch.

In example embodiments, the fifth transistor may be configured to apply the repair data signal to the first terminal of the driving transistor in a turn-on period of the scan signal.

In example embodiments, the driving transistor may be configured to provide the emission current to the OLED through the repair line based on the driving voltage applied to the second node.

In example embodiments, the first emission switch may include a sixth transistor having a gate terminal that receives the emission control signal, a first terminal connected to the second terminal of the first transistor, and a second terminal connected to the first terminal of the driving transistor, and the second emission switch may include a seventh transistor having a gate terminal that receives the emission control signal, a first terminal connected to the second terminal of the driving transistor, and a second terminal connected to the first node.

In example embodiments, the sixth transistor may be configured to connect the first transistor and the driving transistor in a turn-on period of the emission control signal, and the seventh transistor may be configured to connect the driving transistor and the repair line in the turn-on period of the emission control signal.

In example embodiments, the pixel repair circuit may further comprise an eighth transistor having a gate terminal that receives the scan signal, a first terminal connected to the second terminal of the driving transistor, and a second terminal connected to the second node, the eighth transistor compensating a threshold voltage of the driving transistor when the eighth transistor is turned on based on the scan signal, the ninth transistor having a gate terminal that receives the gate initializing signal, a first terminal that receives an initializing voltage, and a second terminal connected to the second node, the ninth transistor initializing the gate terminal of the driving transistor when the ninth transistor is turned on based on the gate initializing signal, and a storage capacitor connected between the power supply voltage and the second node.

Another aspect is an OLED display comprising a display panel including a plurality of pixel circuits each having an OLED, a dummy pixel circuit located outside of the display panel, the dummy pixel circuit including a plurality of pixel repair circuits that provide an emission current to a corresponding one of the OLEDs through a repair line instead of a defective pixel circuit, a scan driver configured to provide a scan signal to the pixel circuits and the pixel repair circuits, a data driver configured to provide a data signal to the pixel circuits, and to provide a repair data signal corresponding to the data signal to the pixel repair circuits, an emission driver configured to provide an emission control signal to the pixel circuits and the pixel repair circuits, and a timing controller configured to control the scan driver, the data driver, and the emission driver. Each of the pixel repair circuits may be configured to initialize the repair line based on a repair line initializing voltage.

In example embodiments, each of the pixel repair circuits may include an emission control unit configured to control the emission current provided to the OLED through the repair line based on the scan signal and the repair data signal, a repair line initialization unit configured to initialize the repair line based on the repair line initializing voltage, the repair line initialization unit being connected to a first node between the repair line and the emission control unit, a current mirror unit configured to provide a mirror current of the emission current to the repair line initialization unit, the current mirror unit being connected between a power supply voltage and the emission control unit, a first emission switch configured to control an electrical connection operation between the emission control unit and the current mirror unit based on the emission control signal, and a second emission switch configured to control an electrical connection operation between the emission control unit and the repair line based on the emission control signal.

In example embodiments, the current mirror unit may include a first transistor having a first terminal connected to the power supply voltage, a second terminal connected to the first emission switch, and a gate terminal connected to the second terminal and configured to provide the emission current to the repair line, and a second transistor having a gate terminal connected to the gate terminal of the first transistor, a first terminal connected to the power supply voltage, and a second terminal connected to the repair line initialization unit and configured to provide the mirror current to the repair line initialization unit.

In example embodiments, the repair line initialization unit may include a third transistor having a gate terminal that receives a gate initializing signal, and a first terminal that receives a direct current voltage, and a fourth transistor having a gate terminal connected to the second terminal of the third transistor, a first terminal that receives the repair line initializing voltage, and a second terminal connected to the first node.

In example embodiments, the third transistor may be configured to apply the direct current voltage to the gate terminal of the fourth transistor in a turn-on period of the gate initializing signal, and the fourth transistor may be configured to initialize the repair line while the direct current voltage is applied to the gate terminal of the fourth transistor.

In example embodiments, the mirror current may be provided to the gate terminal of the fourth transistor.

Another aspect is a pixel repair circuit that provides an emission current to an organic light-emitting diode (OLED) through a repair line, the circuit comprising an emission controller configured to control the emission current based on a scan signal and a repair data signal; a repair line initialization unit configured to initialize the repair line, wherein the repair line initialization unit is connected to a first node between the repair line and the emission controller; a current mirror unit configured to provide a mirror current of the emission current to the repair line initialization unit, wherein the current mirror unit is connected between a power supply voltage and the emission controller; a first emission switch configured to control an electrical connection between the emission controller and the current mirror unit based on an emission control signal; and a second emission switch configured to control an electrical connection between the emission controller and the repair line based on the emission control signal.

The current mirror unit can include a first transistor including: i) a first terminal connected to the power supply voltage, ii) a second terminal connected to the first emission switch, and iii) a gate terminal connected to the second terminal, wherein the first transistor is configured to provide the emission current to the repair line; and a second transistor including: i) a gate terminal connected to the gate terminal of the first transistor, ii) a first terminal connected to the power supply voltage, and iii) a second terminal connected to the repair line initialization unit, wherein the second transistor is configured to provide the mirror current to the repair line initialization unit. The current mirror unit and the emission controller can be respectively configured to generate the emission current and the mirror current when the first emission switch and the second emission switch are turned on. The repair line initializing unit can include a third transistor including: i) a gate terminal configured to receive a gate initializing signal, ii) a first terminal configured to receive a direct current (DC) voltage, and iii) a second terminal; and a fourth transistor including: i) a gate terminal connected to the second terminal of the third transistor, ii) a first terminal configured to receive a repair line initializing voltage, and iii) a second terminal connected to the first node.

The third transistor can be configured to apply the direct current voltage to the gate terminal of the fourth transistor during a turn-on period of the gate initializing signal and the fourth transistor can be configured to initialize the repair line when the fourth transistor is turned on in response to the direct current voltage being applied to the gate terminal of the fourth transistor. The current mirror unit can be further configured to provide the mirror current to the gate terminal of the fourth transistor. The fourth transistor can be configured to be turned off when the mirror current is greater than a threshold. The repair line initializing unit can further include a hold capacitor connected between the power supply voltage and the gate terminal of the fourth transistor. The emission controller can include a fifth transistor including: i) a gate terminal configured to receive the scan signal and ii) a first terminal configured to receive the repair data signal; a second node configured to receive a driving voltage; and a driving transistor including: i) a gate terminal connected to the second node, ii) a first terminal connected to the second terminal of the first transistor via the first emission switch, and ii) a second terminal connected to the second emission switch.

The fifth transistor can be configured to apply the repair data signal to the first terminal of the driving transistor during a turn-on period of the scan signal. The driving transistor can be configured to provide the emission current to the OLED through the repair line based on the driving voltage applied to the second node. The first emission switch can include a sixth transistor including: i) a gate terminal configured to receive the emission control signal, ii) a first terminal connected to the second terminal of the first transistor, and ii) a second terminal connected to the first terminal of the driving transistor, and wherein the second emission switch includes: a seventh transistor including: i) a gate terminal configured to receive the emission control signal, ii) a first terminal connected to the second terminal of the driving transistor, and iii) a second terminal connected to the first node. The sixth transistor can be configured to connect the first transistor to the driving transistor during a turn-on period of the emission control signal and the seventh transistor can be configured to connect the driving transistor to the repair line during the turn-on period of the emission control signal.

The circuit can further comprise an eighth transistor including: i) a gate terminal configured to receive the scan signal, ii) a first terminal connected to the second terminal of the driving transistor, and iii) a second terminal connected to the second node, wherein the eighth transistor is configured to compensate a threshold voltage of the driving transistor when the eighth transistor is turned on based on the scan signal; a ninth transistor including: i) a gate terminal configured to receive the gate initializing signal, ii) a first terminal configured to receive an initializing voltage, and iii) a second terminal connected to the second node, wherein the ninth transistor is configured to initialize the gate terminal of the driving transistor when the ninth transistor is turned on based on the gate initializing signal; and a storage capacitor connected between the power supply voltage and the second node.

Another aspect is an organic light-emitting diode (OLED) display, comprising a display panel including a plurality of pixel circuits each having an OLED; a dummy pixel circuit located outside of the display panel, wherein the dummy pixel circuit includes a plurality of pixel repair circuits each configured to provide an emission current to a corresponding one of the OLEDs through a corresponding repair line; a scan driver configured to provide a plurality of scan signals to the pixel circuits and the pixel repair circuits; a data driver configured to: i) provide a plurality of data signals to the pixel circuits and ii) provide a plurality of repair data signals respectively corresponding to the data signals to the pixel repair circuits; an emission driver configured to provide an emission control signal to the pixel circuits and the pixel repair circuits; and a timing controller configured to control the scan driver, the data driver, and the emission driver, wherein each of the pixel repair circuits is configured to initialize the repair line based on a repair line initializing voltage.

Each of the pixel repair circuits can include an emission controller configured to control the emission current provided to a corresponding one of the OLEDs through the repair line based on the scan signal and the repair data signal; a repair line initialization unit configured to initialize the repair line based on the repair line initializing voltage, wherein the repair line initialization unit is connected to a first node between the repair line and the emission controller; a current mirror unit configured to provide a mirror current of the emission current to the repair line initialization unit, wherein the current mirror unit is connected between a power supply voltage and the emission controller; a first emission switch configured to control an electrical connection between the emission controller and the current mirror unit based on the emission control signal; and a second emission switch configured to control an electrical connection between the emission controller and the repair line based on the emission control signal.

The current mirror unit can include a first transistor including: i) a first terminal connected to the power supply voltage, ii) a second terminal connected to the first emission switch, and iii) a gate terminal connected to the second terminal, wherein the first transistor is configured to provide the emission current to the repair line; and a second transistor including: i) a gate terminal connected to the gate terminal of the first transistor, ii) a first terminal connected to the power supply voltage, and iii) a second terminal connected to the repair line initializing unit, wherein the second transistor is configured to provide the mirror current to the repair line initialization unit. The repair line initializing unit can include a third transistor including: i) a gate terminal configured to receive a gate initializing signal, ii) a first terminal configured to receive a direct current voltage, and iii) a second terminal; and a fourth transistor including: i) a gate terminal connected to the second terminal of the third transistor, ii) a first terminal configured to receive the repair line initializing voltage, and iii) a second terminal connected to the first node.

The third transistor can be configured to apply the direct current voltage to the gate terminal of the fourth transistor during a turn-on period of the gate initializing signal and the fourth transistor can be configured to initialize the repair line while the direct current voltage is applied to the gate terminal of the fourth transistor. The current mirror unit can be further configured to provide the mirror current to the gate terminal of the fourth transistor.

According to at least one embodiment, the pixel repair circuit is configured to initialize the initialization line such that any coupling effect due to the parasitic capacitors is prevented (or canceled). For example, bright spots (or white spots) caused by an increase in the emission current provided to the OLED can be prevented when the OLED emits light based on low gray levels (e.g., gray level zero to about gray level 30) or low luminance.

In addition, the OLED display having the pixel repair circuit can form a high quality display as the bright spots are decreased.

DETAILED DESCRIPTION OF CERTAIN INVENTIVE EMBODIMENTS

Organic light-emitting diode (OLED) displays can include a pixel repair circuit in a non-display area (or external to a display panel) of the display. It provides an emission current to one of the OLEDs in the place of a defective pixel circuit detected during the manufacture of the display. A repair line transmits the emission current to the OLED. The repair line can be formed adjacent to other signal lines such as scan lines, data lines, gate initializing lines, emission control lines, etc. Thus, the repair line may be electrically coupled to one of the other signal lines due to its close proximity to the other signal line and parasitic capacitances can form during an emission period. This leads to an increase or fluctuation in the emission current. This increase in emission current can form a bright spot on the display when the pixel repair circuit receives low gray levels (e.g., gray level zero to about gray level 30).

Exemplary embodiments will be described more fully hereinafter with reference to the accompanying drawings, in which various embodiments are shown.

Figure 1:
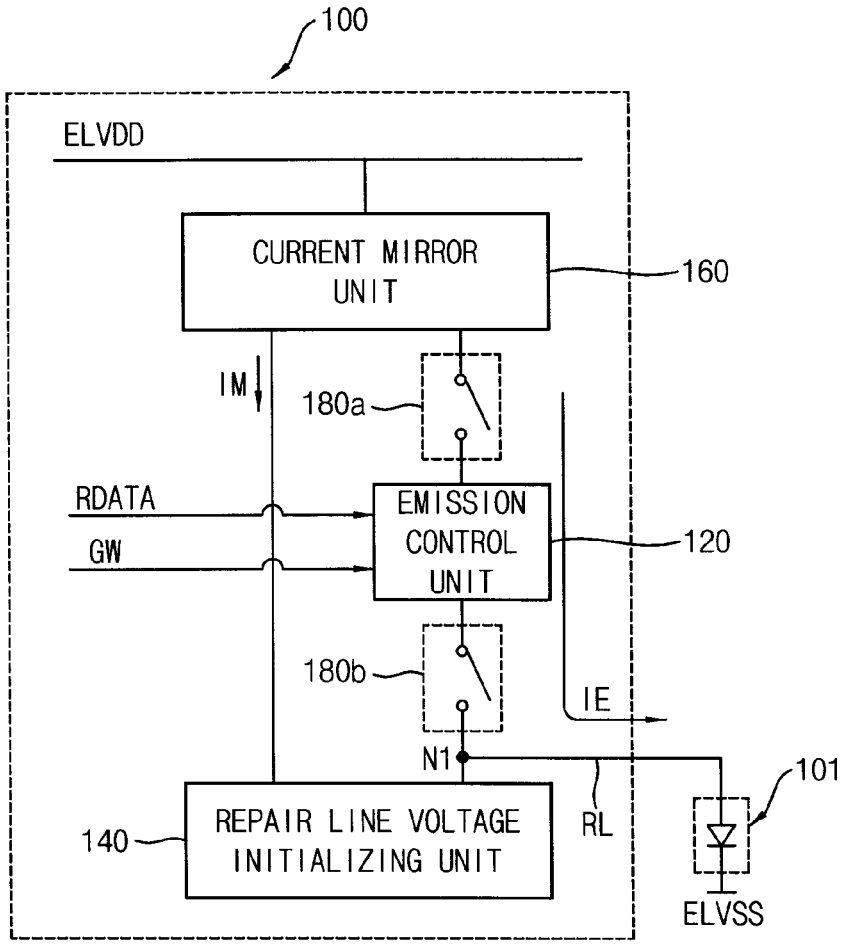
FIG. 1 is a block diagram illustrating a pixel repair circuit according to example embodiments.
Figure 2:
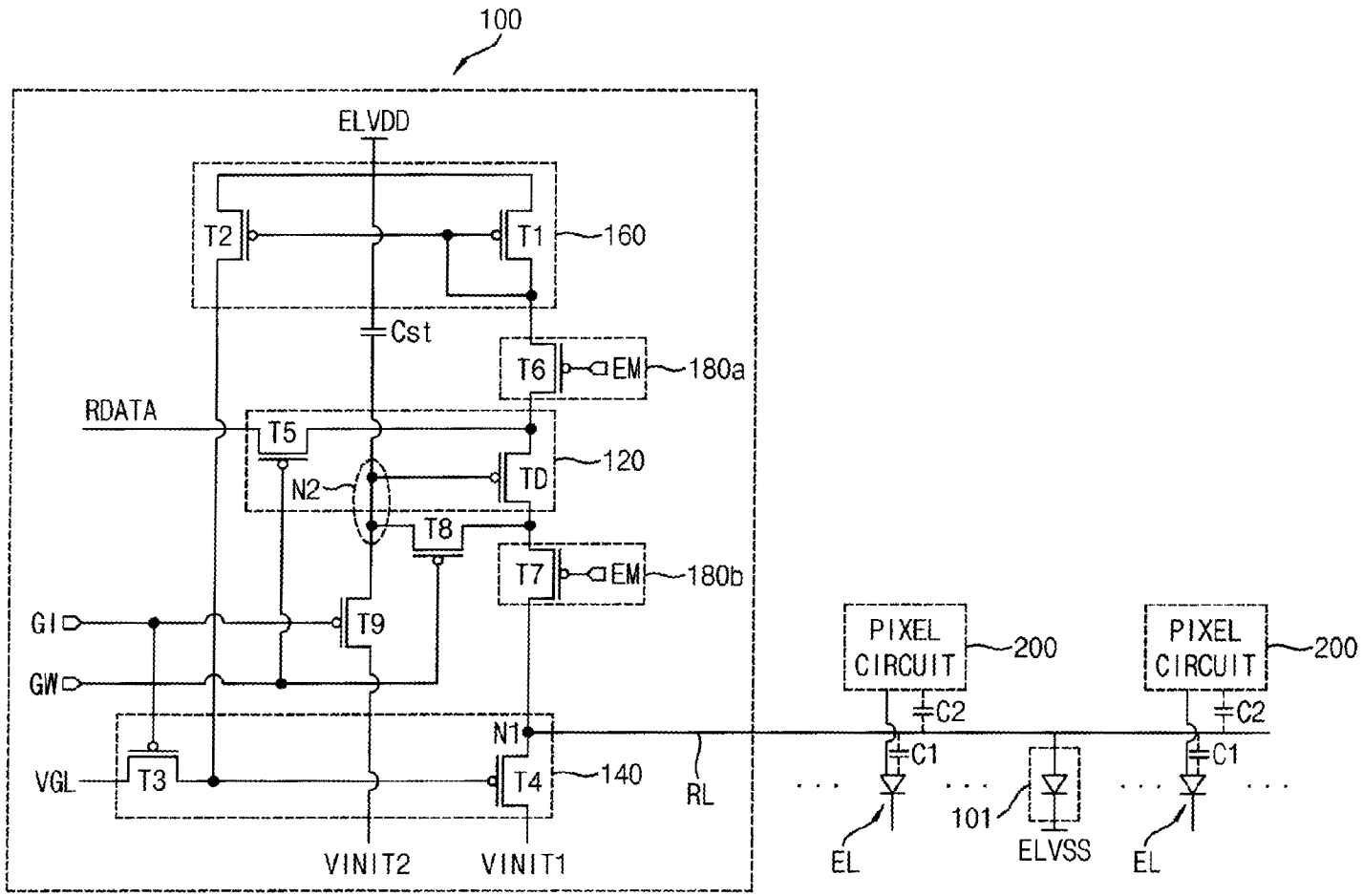
FIG. 2 is a diagram illustrating one example of the pixel repair circuit of FIG. 1.

FIG. 1 is a block diagram illustrating a pixel repair circuit according to example embodiments. FIG. 2 is a diagram illustrating one example of a pixel repair circuit of FIG. 1.

Referring to FIGS. 1 and 2, the pixel repair circuit 100 includes an emission control unit or emission controller 120, a repair line initialization unit 140, a current mirror unit 160, a first emission switch 180*a*, and a second emission switch 180*b*. When a defective pixel circuit is detected, the pixel repair circuit 100 provides an emission current IE to an OLED 101 through a repair line RL instead of the defective pixel circuit. The defective pixel circuit can be disconnected from the OLED 101 via a laser cut, etc.

As illustrated in FIG. 1, the emission control unit 120 controls the emission current IE provided to the OLED 101 through the repair line RL based on a scan signal GW and a repair data signal RDATA. The emission control unit 120 is connected to the repair line RL. The repair line RL transmits the emission current IE to the OLED 101.

The scan signal GW controls the timing at which the emission control unit 120 receives the repair data signal RDATA. The repair data signal RDATA has a voltage level which corresponds to a specific gray level. In one example embodiment, the emission control unit 120 receives the scan signal GW through a scan line and receives the repair data signal RDATA through a repair data line connected to a data line. Thus, the repair data signal RDATA corresponds to a data signal that is applied to the defective pixel circuit. Therefore, when a defective pixel circuit is detected and is electrically disconnected from the OLED 101, the emission current IE can be provided to the OLED 101 via the pixel repair circuit 100.

The repair line initialization unit 140 initializes the repair line RL. The repair line initialization unit 140 is connected to a first node N1 between the repair line RL and the emission control unit 120. The repair line initialization unit 140 initializes the repair line RL. The repair line RL is formed a display panel to cover a predetermined display area. For example, the repair line RL may be formed substantially parallel to the data line or a scan line in the display panel.

The repair line RL is formed adjacent to other signal lines such as the scan lines, the data lines, gate initial lines, emission control lines, etc. Thus, the repair line RL may be coupled to one or more of the other signal lines and parasitic capacitances may be formed between the repair line RL and the other signal lines during the emission period, causing the emission current to increase (or fluctuate) under certain conditions. For example, a parasitic capacitance C1 may be formed between the repair line RL and anodes of OLEDs EL (as illustrated in FIG. 2). A parasitic capacitance C2 may be electrically formed between the repair line RL and anode initializing lines that transmit an anode initializing signal to pixel circuits 200.

The repair line initialization unit 140 initializes the repair line RL to a predetermined voltage level (e.g., a repair line initializing voltage) in each frame. Thus, the emission current IE can be reliably provided to the OLED 101.

The current mirror unit 160 provides a mirror current IM of the emission current IE to the repair line initialization unit 140. The current mirror unit 160 is connected between a power supply voltage ELVDD and the emission control unit 120. In one example embodiment, the emission current IE is generated in an emission period. The current mirror unit 160 generates the mirror current IM based on the emission current IE. In some embodiments, the value of the mirror current IM is proportional to the value of the emission current IE. Thus, as the value of the emission current IE increases, the mirror current IM also increases. In one example embodiment, the value of the mirror current IM is substantially the same as the value of the emission current IE. In another example embodiment, the value of the mirror current IM is less than the value of the emission current IE.

In some embodiments, the gray level voltage applied to the pixel repair circuit 100 is proportional to the value of the emission current IE (and the value of the mirror current IM). The operation time of the repair line initialization unit 140 is be controlled by the mirror current IM. For example, as the value of the mirror current IM increases, the operation time of the repair line initialization unit 140 decreases. Thus, as the gray level (i.e., the gray level voltage) increases, the repair line RL initialization time decreases in the emission period.

The first emission switch 180*a* controls the electrical connection between the emission control unit 120 and the current mirror unit 160 based on an emission control signal EM. The second emission switch 180*b* controls the electrical connection between the emission control unit 120 and the repair line RL based on the emission control signal EM.

In one example embodiment, the first and second emission switches 180*a* and 180*b* are simultaneously turned on or off based on the emission control signal EM. For example, the first and second emission switches 180*a* and 180*b* electrically connect the current mirror unit 160, the emission control unit 120, and the repair line RL when the emission current IE is provided to the OLED 101. The first emission switch 180*a* electrically separates the current mirror unit 160 from the emission control unit 120 and the second emission switch 180*b* electrically separates the emission control unit 120 from repair line RL when the emission current IE is not provided to the OLED 101.

As illustrated in the FIG. 2 embodiment, the current mirror unit 160 includes a first transistor T1 and a second transistor T2. The repair line initialization unit 140 includes a third transistor T3 and a fourth transistor T4. The emission control unit 120 includes a fifth transistor T5 and a driving transistor TD.

In the embodiment of FIG. 2, the current mirror unit 160 includes the first transistor T1 and the second transistor T2. The first transistor T1 has a first terminal connected to the power supply voltage ELVDD, a second terminal connected to the first emission switch 180*a*, and a gate terminal connected to the second terminal. The second transistor T2 has a gate terminal connected to the gate terminal of the first transistor T1, a first terminal connected to the power supply voltage ELVDD, and a second terminal connected to the repair line initialization unit 140. The second transistor T2 provides the mirror current IM to the repair line initialization unit 140. The first and second transistors T1 and T2 generate the mirror current IM based on the emission current IE that is generated in the emission control unit 120. The mirror current IM is provided to the repair line initialization unit 140. However, the described technology is not limited to the above described circuit configuration of the current mirror unit 160.

The value of the mirror current IM is controlled by, for example, the sizes of the channel regions of the first and second transistors T1 and T2. The value of the mirror current IM can be controlled by the relationship between the ratio of a channel length (L1) to the channel width (W1) (i.e., W1/L1) of the first transistor T1 and a ratio of the channel length (L2) to the channel width (W2) (i.e., W2/L2) of the second transistor T2. The relationship can be represented by following equation.

$$IM = \frac{W2/L2}{W1/L1} \cdot IE \qquad \text{Equation 1}$$

Thus, if the sizes of the first and second transistors T1 and T2 are substantially the same, the mirror current IM is substantially the same as the emission current IE. However, these are examples, and the ratio of the mirror current IM to the emission current IE is not limited thereto.

In one example embodiment, the repair line initialization unit 140 includes the third transistor T3 and the fourth transistor T4. The third transistor T3 has a gate terminal that receives a gate initializing signal GI, and a first terminal that receives the direct current voltage VGL that turns on the fourth transistor T4. The fourth transistor T4 has a gate terminal connected to the second terminal of the third transistor T3, a first terminal that receives a repair line initializing voltage VINIT1, and a second terminal connected to the first node N1.

The third transistor T3 applies the direct current voltage VGL to the gate terminal of the fourth transistor T4 during a turn-on period of the gate initializing signal GI. The direct current voltage VGL is a turn-on voltage that can turn on the fourth transistor T4. The fourth transistor T4 can be turned on by receiving the direct current voltage VGL and can apply the repair line initializing voltage VINIT1 to the repair line RL. The repair line RL can thus be initialized to the repair line initializing voltage VINIT1. When the fourth transistor T4 is turned off, the initialization of the repair line RL is discontinued.

In one example embodiment, the mirror current IM is applied to the gate terminal of the turned-on fourth transistor T4. Then, the voltage of the gate terminal of the fourth transistor T4 increases due to the applied mirror current IM. Thus, the fourth transistor T4 can be turned off after a certain time by receiving the mirror current IM. In one example embodiment, as the value of the mirror current IM increases, the fourth transistor T4 is turned off more quickly. In other words, as the value of the gray level increases, the repair line RL initialization time decreases.

In one example embodiment, the voltage that initializes the repair line RL corresponds to the repair line initializing voltage VINIT1. The repair line initializing voltage VINIT1 may be, for example, from about −1.8 V to about −2.0 V. The repair line initializing voltage VINIT1 may be different from an initializing voltage VINIT2 which initializes a gate terminal of the driving transistor TD. In the emission period, a voltage fluctuation at the repair line RL due to the parasitic capacitances C1 and C2 can be canceled (or compensated) by applying the repair line initializing voltage VINIT1 to the repair line RL. Thus, the emission current IE can be prevented from sharply increasing, thus preventing the light emitted from the OLED 101 from not corresponding to the gray level that is applied to the pixel repair circuit 100.

The emission control unit 120 includes the fifth transistor T5 and the driving transistor TD. The fifth transistor T5 has a gate terminal that receives the scan signal GW and a first terminal that receives the repair data signal RDATA. The driving transistor TD has a gate terminal connected to a second node N2 that receives a driving voltage, a first terminal connected to the second terminal of the first transistor T1 via the first emission switch 180*a*, and a second terminal connected to the second emission switch 180*b*.

In the embodiment of FIG. 2, the fifth transistor T5 applies the repair data signal RDATA to the driving transistor TD based on the scan signal GW. In one example embodiment, the fifth transistor T5 applies the repair data signal RDATA to the first terminal of the driving transistor TD during a turn-on period of the scan signal GW. The driving transistor TD generates the emission current IE based on the driving voltage which is applied to the second node N2. The emission current IE is then provided to the OLED 101 through the repair line RL.

In one example embodiment, the first emission switch 180*a* includes a sixth transistor. The sixth transistor 180*a* has a gate terminal that receives the emission control signal EM, a first terminal connected to the second terminal of the first transistor T1, and a second terminal connected to the first terminal of the driving transistor TD. The first emission switch 180*a* connects the first transistor T1 to the driving transistor TD when the gate terminal of the sixth transistor T6 receives an activated emission control signal EM during a turn-on period of the emission control signal EM. The turn-on period of the emission control signal EM may correspond to an emission period of a frame. The turn-off period of the emission control signal EM may correspond to a non-emission period of the frame.

In one example embodiment, the second emission switch 180*b* includes a seventh transistor T7. The seventh transistor T7 has a gate terminal that receives the emission control signal EM, a first terminal connected to the second terminal of the driving transistor TD, and a second terminal connected to the first node N1. The second emission switch 180*b* connects the driving transistor TD to the repair line RL when the gate terminal of the seventh transistor T7 receives an activated emission control signal EM during a turn-on period of the emission control signal EM.

In the embodiment of FIG. 2, the emission current IE is generated in the emission period (i.e., a period that the sixth and seventh transistors T6 and T7 are turned on). At the same time the mirror current IM is generated in the current mirror unit 160. Thus, the mirror current IM is provided to the gate terminal of the fourth transistor T4 in the emission period.

In one example embodiment, the pixel repair circuit 100 further includes an eighth transistor T8 and a ninth transistor T9. The eighth transistor T8 has a gate terminal that receives the scan signal GW, a first terminal connected to the second terminal of the driving transistor TD, and a second terminal connected to the second node N2. The eighth transistor T8 can compensate the threshold voltage of the driving transistor TD when the eighth transistor T8 is turned on based on the scan signal GW. When the eighth transistor T8 is turned on by receiving an activated scan signal GW, a current pass is formed between the gate and second terminals of the driving transistor TD. Thus, the voltage difference between the power supply voltage ELVDD and the threshold voltage of the driving transistor TD is applied to the gate terminal of the driving transistor TD. Accordingly, the threshold voltage of the driving transistor TD is compensated.

In one example, the ninth transistor T9 has a gate terminal that receives the gate initializing signal GI, a first terminal that receives the initializing voltage VINIT2, and a second terminal connected to the second node N2. The ninth transistor T9 initializes the gate terminal voltage of the driving transistor TD when the ninth transistor T9 is turned on based on the gate initializing signal GI. When the ninth transistor T9 is turned on by receiving an activated gate initializing signal GI, the initializing voltage VINIT2 is applied to the second node N2. Thus, the gate terminal of the driving transistor TD can be initialized.

In one example embodiment, the pixel repair circuit 100 further includes a storage capacitor Cst. The storage capacitor Cst is connected between the second node N2 and the power supply voltage ELVDD. The storage capacitor Cst can store a voltage difference between the power supply voltage ELVDD and the gate terminal of the driving transistor TD.

As described above, the pixel repair circuit 100 in FIGS. 1 and 2 initializes the voltage of the repair line RL such that a coupling effect generated due to the parasitic capacitors C1 and C2 can be prevented (or canceled). Therefore, bright spots (or white spots) caused by increasing the emission current IE provided to the OLED 101 can be decreased (or prevented from being generated) when the OLED 101 emits light based on low gray levels (e.g., gray level zero to about gray level 30) or low luminance.

Figure 3:
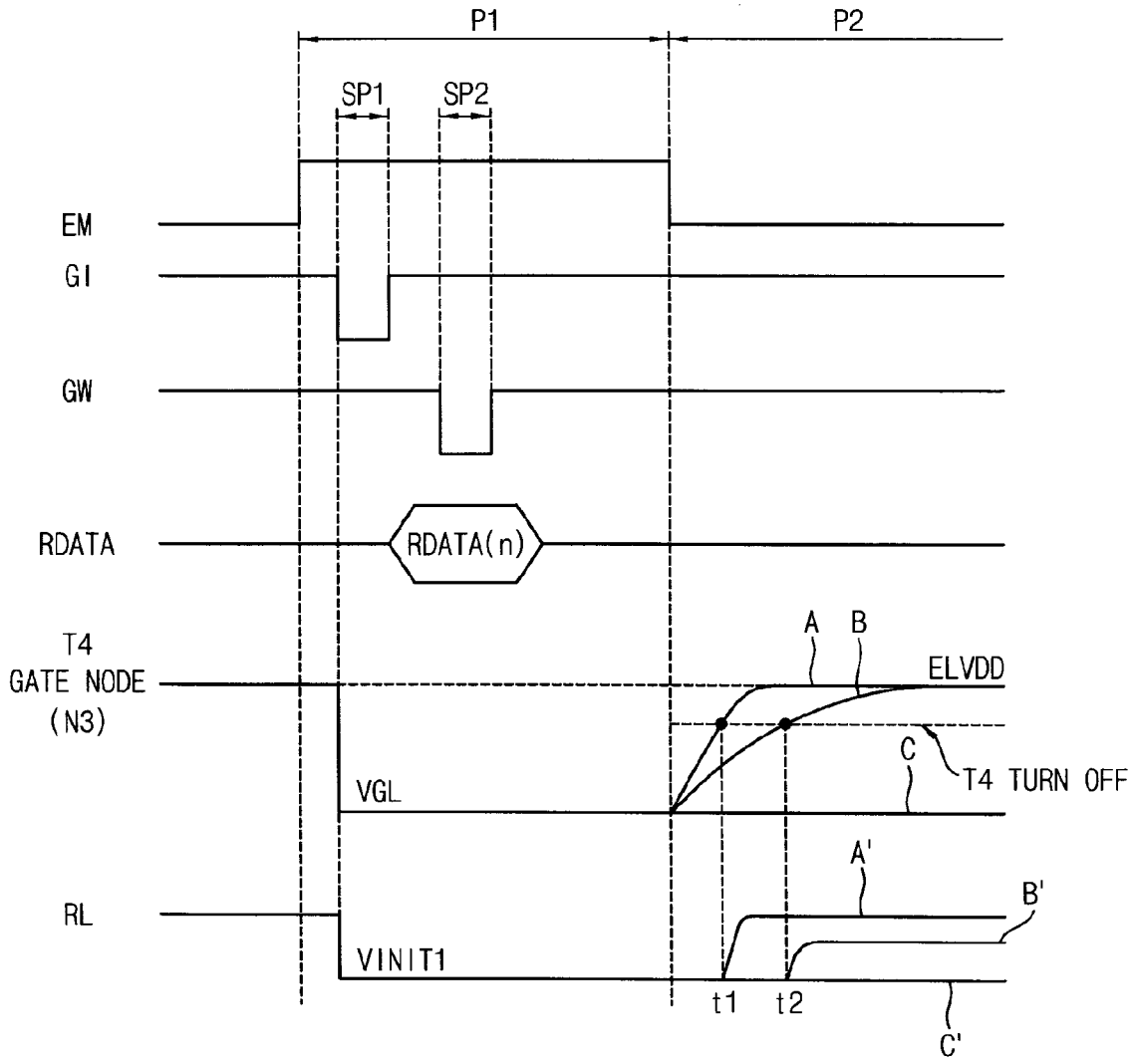
FIG. 3 is a timing diagram illustrating one example of operation of the pixel repair circuit of FIG. 2.

FIG. 3 is a timing diagram illustrating one example of an operation of the pixel repair circuit of FIG. 2.

Referring to FIG. 3, the timing diagram illustrates the operations of an emission control signal EM, a gate initializing signal GI, a scan signal GW, and a repair data signal RDATA. The timing diagram of FIG. 3 illustrates voltage changes at the gate terminal N3 (i.e., a third node N3) of the fourth transistor T4 and voltage changes at the repair line RL (i.e., the first node N1).

In one example embodiment, a period P1 is a non-emission period (i.e., the OLED 101 does not emit light in the period P1.) and a period P2 is an emission period (i.e., the OLED 101 emits light in the period P2.). FIG. 3 show signals that are applied to the pixel repair circuit 100 shown in FIG. 2 and the transistors of the pixel repair circuit 100 of FIG. 2 are realized as PMOS transistors such that the driving timings shown in FIG. 3 are represented. If the transistors of the pixel repair circuit 100 of FIG. 2 are NMOS transistors, the same operation as the driving of FIG. 3 is executed by signals that are inverted with respect to the corresponding signals of FIG. 3.

The emission control signal EM may be increased (to a high state or level) during the period P1 such that the sixth and seventh transistors T6 and T7 are turned off. Thus, the light emitted by the OLED 101 in the previous frame is stopped and the OLED 101 does not emit light.

Next, the gate initializing signal GI transitions to a low level (i.e. represented by the first sub-period SP1) such that the third and ninth transistors T3 and T9 are turned on. Then, the direct current voltage VGL is applied to the gate terminal N3 of the fourth transistor T4 so that the fourth transistor T4 is turned on and the repair line initializing voltage VINIT1 is applied to the repair line RL (i.e., the repair line RL is initialized with the repair line initializing voltage VINIT1.). The fourth transistor remains turned on for the period P1 so that the voltage of the repair line RL is maintained at the repair line initializing voltage VINIT1. In addition, the ninth transistor T9 is turned on such that the gate terminal of the driving transistor TD (i.e., the second node N2) is initialized by the initial voltage VINIT2.

In a second sub-period SP2, the gate initializing signal GI is at a high level and the scan signal GW is transitioned to a low level. When the scan signal GW is at the low level, the fifth and eighth transistors T5 and T8 are turned on. The third and ninth transistors T3 and T9 are turned off when the gate initializing signal GI increases. When the fifth transistor T5 is turned on, the repair data signal RDATA is applied to the first terminal of the driving transistor TD. The driving voltage based on the repair data voltage RDATA is thus applied to the second node N2. Further, the driving transistor TD is diode-connected since the eighth transistor T8 is turned on during the second sub-period SP2 so that the threshold voltage of the driving transistor TD is compensated.

The fifth and eighth transistors T5 and T8 are turned off when the scan signal GW transitions to a high level.

The emission control signal EM transitions to a low level during the period P2 such that the sixth and seventh transistors T6 and T7 are turned off. The driving transistor TD generates the emission current IE corresponding to the driving voltage (i.e., a certain gray level). The emission current IE is provided to the OLED 101.

The current mirror unit 160 provides the mirror current IM based on the emission current IE to the gate terminal of the fourth transistor T4 of the repair line initialization unit 140 to turn off the fourth transistor T4 in the period P2. The turn-off speed of the fourth transistor T4 depends on the value of the mirror current IM. The fourth transistor T4 is turned off such that the emission current IE can be provided to the repair line RL.

For example, the luminance of the OLED 101 is controlled by the value of gray level (gray level voltage) which is applied to the first terminal of the driving transistor TD. The gray level can be divided into, for example, 256 levels (e.g., gray level 0 to gray level 255). As the gray level increases, the OLED 101 emits light with a greater luminance. For example, when the gray level is above the 200 level, the OLED 101 emits bright light or white light.

When the OLED 101 emits light based on a high gray level such as from about gray level 200 to the maximum gray level (i.e. represented as A), the mirror current IM having several hundred pico-amperes (pA) is provided to the gate terminal of the fourth transistor T4 such that the fourth transistor T4 is turned off at a time t1. A voltage A' applied to the repair line RL corresponding to the high gray level is applied to the repair line RL from the time t1 such that the OLED 101 emits light corresponding to the high gray level.

When the OLED 101 emits light based on a middle gray level (e.g., from about gray level 30 to about gray level 200) (i.e., represented as B), the mirror current IM having from several tens to several hundred pico-amperes (pA) is provided to the gate terminal of the fourth transistor T4 such that the fourth transistor T4 is turned off at a time t2 that is later than the time t1. A voltage B' applied to the repair line RL corresponding to the middle gray level is applied to the repair line RL from the time t2 such that the OLED 101 may emits light corresponding to the middle gray level.

When the OLED 101 emits light based on a low gray level (e.g., below gray level 30 including minimum gray level) or black gray level (i.e., represented as C), the mirror current IM having several pico-amperes (pA) is provided to the gate terminal of the fourth transistor T4. The value of the mirror current IM is low enough such that the fourth transistor T4 is held in the turned-on state for a sufficient time. Thus, the repair line RL (i.e., the third node N3) consistently receives the repair line initializing voltage VINIT1. In one example embodiment, a voltage C' applied to the repair line RL corresponding to the low gray level and/or black gray level (i.e., gray level zero) corresponds to the value of the repair line initializing voltage. Thus, bright spots caused by the parasitic capacitances can be prevented when the OLED 101 emits light based on low gray levels (e.g., gray level zero to about gray level 30) or low luminance. Since users cannot perceive bright spots when the OLED 101 emits light based on high gray levels and middle gray levels, it is not necessary for the voltage of the repair line RL to be initialized for a long time in the emission period P2.

Figure 4:
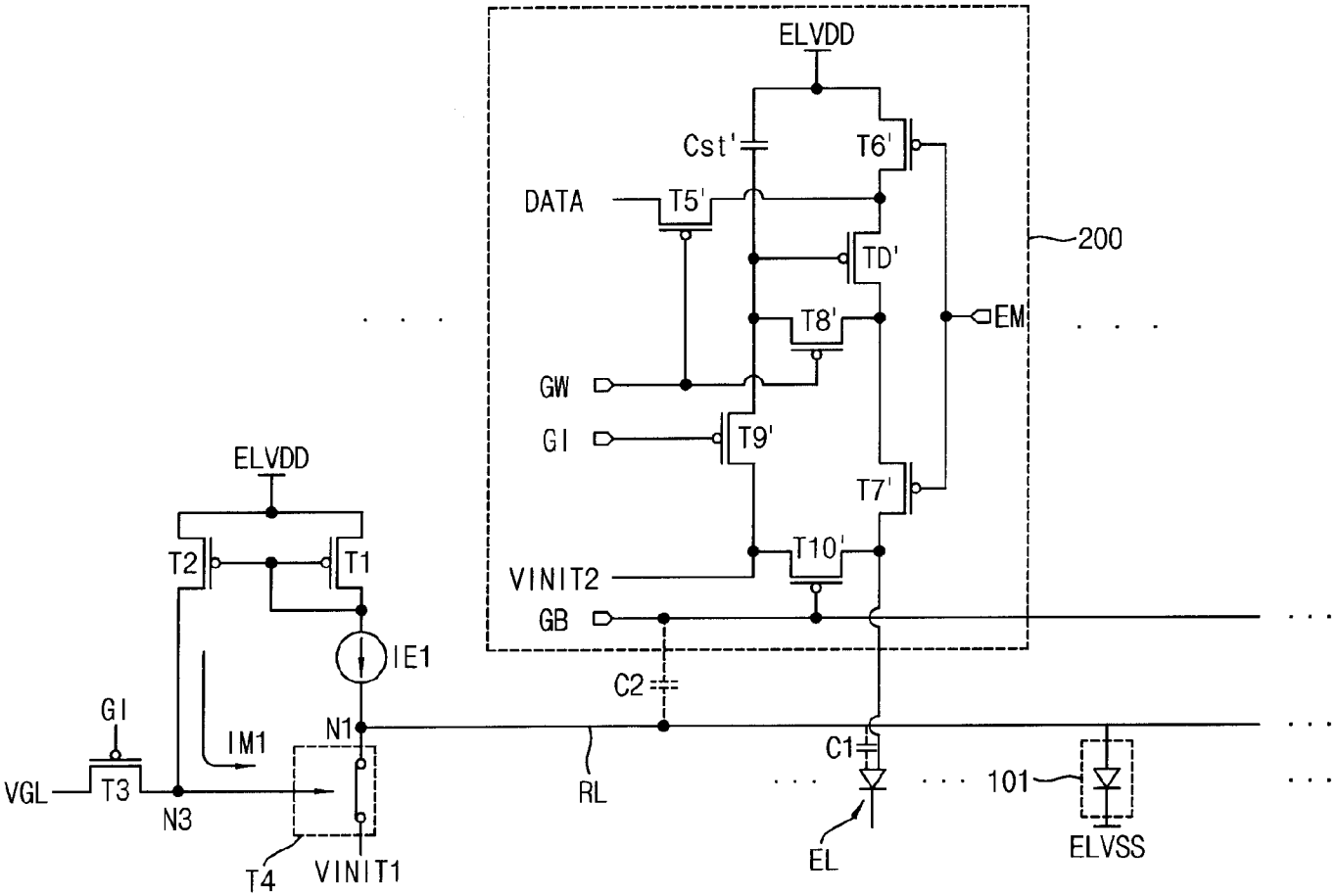
FIG. 4 is a diagram illustrating one example of operation of the pixel repair circuit of FIG. 2 in an emission period.
Figure 5:
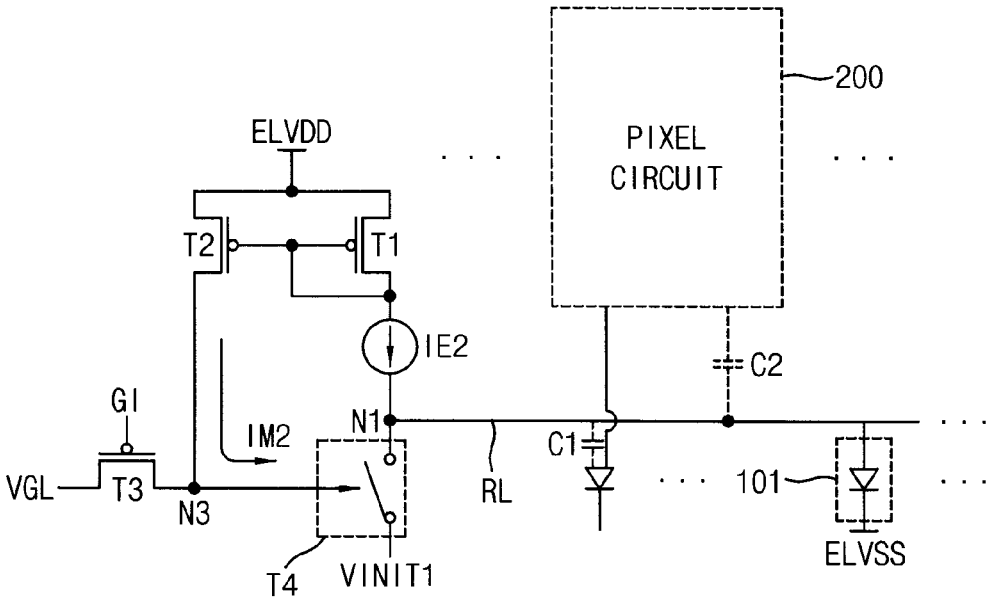
FIG. 5 is a diagram illustrating another example of operation of the pixel repair circuit of FIG. 2 in the emission period.

FIG. 4 is a diagram illustrating one example of the operation of the pixel repair circuit of FIG. 2 in an emission period and FIG. 5 is a diagram illustrating another example of the operation of the pixel repair circuit of FIG. 2 in the emission period. Specifically, FIG. 4 illustrates one example of the operation of the pixel repair circuit in a fourth transistor turn-on period and FIG. 5 illustrates one example of the operation of the pixel repair circuit in a fourth transistor turn-off period. In FIGS. 4 and 5, like reference numerals are used to designate elements the same as those in FIG. 2, and detailed description of these elements may be omitted.

Referring to FIG. 4, the fourth transistor T4 is turned on and the repair line initializing voltage VINIT1 is applied to the repair line RL.

A normally operating pixel circuit 200 may be similar to the pixel repair circuit 100. Thus, a fifth, sixth, seventh, eighth, and ninth transistors T5', T6', T7', T8', and T9' and a driving transistor TD' may act substantially the same as the fifth, sixth, seventh, eighth, and ninth transistors T5, T6, T7, T8, and T9 and a driving transistor TD of FIG. 2 and detailed descriptions of these elements may be omitted.

In one example embodiment, the pixel circuit 200 further includes a tenth transistor T10' initializing a voltage of an anode of an OLED EL. The tenth transistor T10' has a gate terminal that receives an anode initializing signal GB, a first terminal that receives the initializing voltage VINT2, and a second terminal connected to a second terminal of the seventh transistor T7'. When the tenth transistor T10' is turned on by receiving an activated anode initializing signal GB, the initializing voltage VINIT2 is applied to the anode of the OLED EL. Thus, the anode of the OLED EL is initialized. The pixel circuit 200 further includes a capacitor Cst' connected between the power supply voltage ELVDD and the ninth transistor T9'.

A parasitic capacitance C1 may be electrically formed between the repair line RL and an anode of OLED EL. A parasitic capacitance C2 may be electrically formed between the repair line RL and an anode initializing line GB that transmits an anode initializing signal to pixel circuits 200.

When the fourth transistor T4 is turned on, the repair line RL receives the repair line initializing voltage VINT1 to prevent the formation of the parasitic capacitances C1 and C2. Thus, the emission current IE1 from the pixel repair circuit 100 is provided to the OLED 101 stably in the emission period.

Referring to FIG. 5, the fourth transistor T4 may be turned off and the initialization of the voltage of the repair line RL is stopped. Thereafter, the pixel current IE2 may be affected by the coupling effect (or, parasitic capacitance) between the repair line RL and other lines such as the anode initializing signal GB (e.g., be affected by the parasitic capacitances C1 and C2). However, when the OLED 101 emits light based on middle or high gray levels, a bright spot caused by increases in the emission current IE are not perceptible to the naked eye so that effect from the parasitic capacitances C1 and C2 can be ignored.

Figure 6:
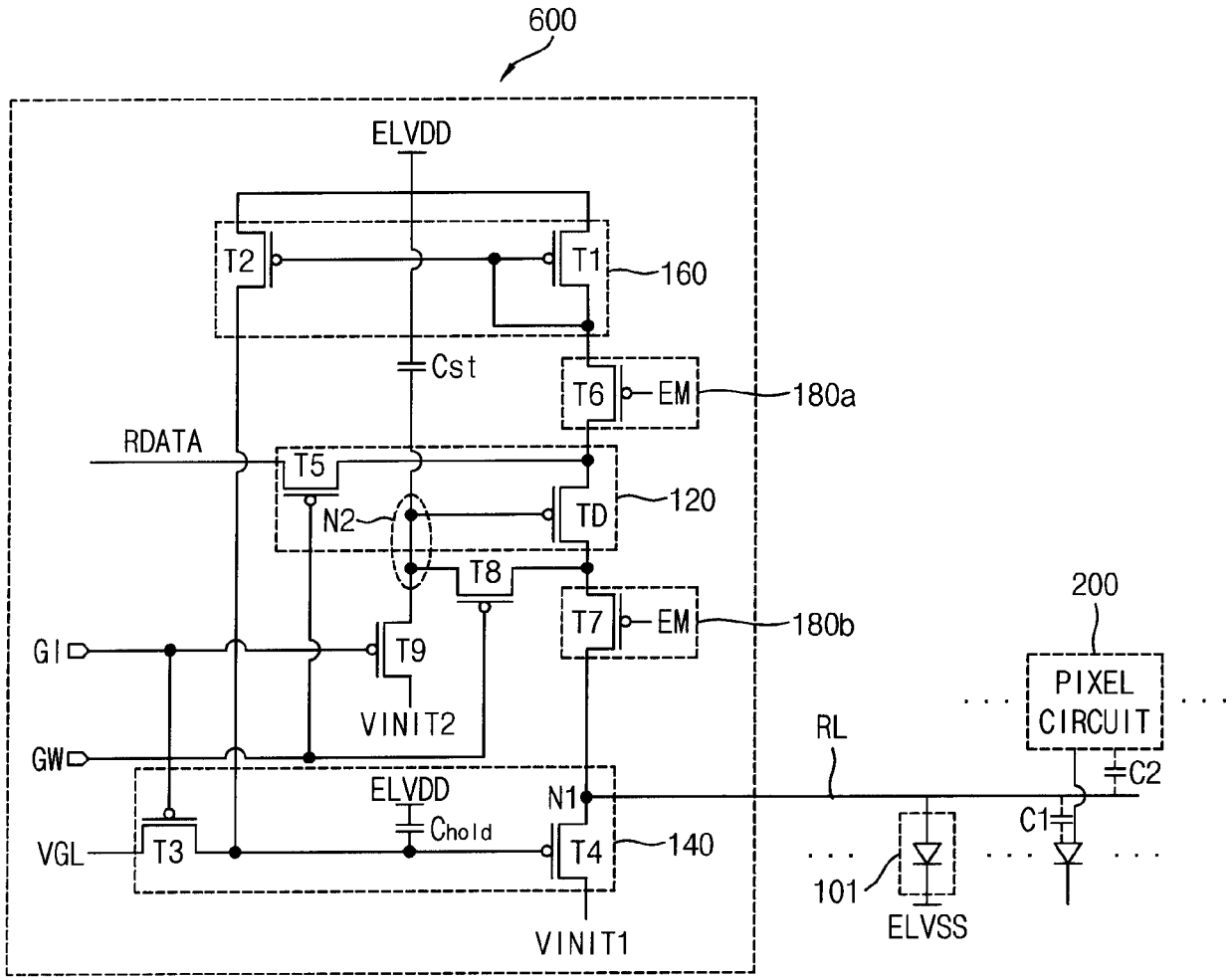
FIG. 6 is a diagram illustrating another example of the pixel repair circuit of FIG. 1.

FIG. 6 is a diagram illustrating another example of a pixel repair circuit of FIG. 1.

Referring to FIG. 6, pixel repair circuit 600 includes the emission control unit 120, the repair line initialization unit 140, the current mirror unit 160, the first emission switch 180*a*, and the second emission switch 180*b*. In FIG. 6, like reference numerals are used to designate elements of the pixel repair circuit that are the same as those in FIG. 2 and detailed description of these elements may be omitted. The pixel repair circuit 600 of FIG. 6 may be substantially the same as or similar to the pixel repair circuit of FIG. 2 except for a hold capacitor Chold.

In one example embodiment, the repair line initialization unit 140 further includes the hold capacitor Chold. The hold capacitor Chold is connected between the power supply voltage ELVDD and the gate terminal of the fourth transistor T4. The hold capacitor stores a voltage difference between the power supply voltage ELVDD and a voltage of the gate terminal of the fourth transistor T4.

The fourth transistor T4 may not be turned off when applied with a very low mirror current IM when the low gray level is applied to the pixel repair circuit 600, resulting in the display of a dark spot in the display panel. In this situation, the hold capacitor Chold is discharged to turn on the fourth transistor T4. Thus, the dark spot can be prevented from being generated when the hold capacitor Chold is discharged.

Figure 7:
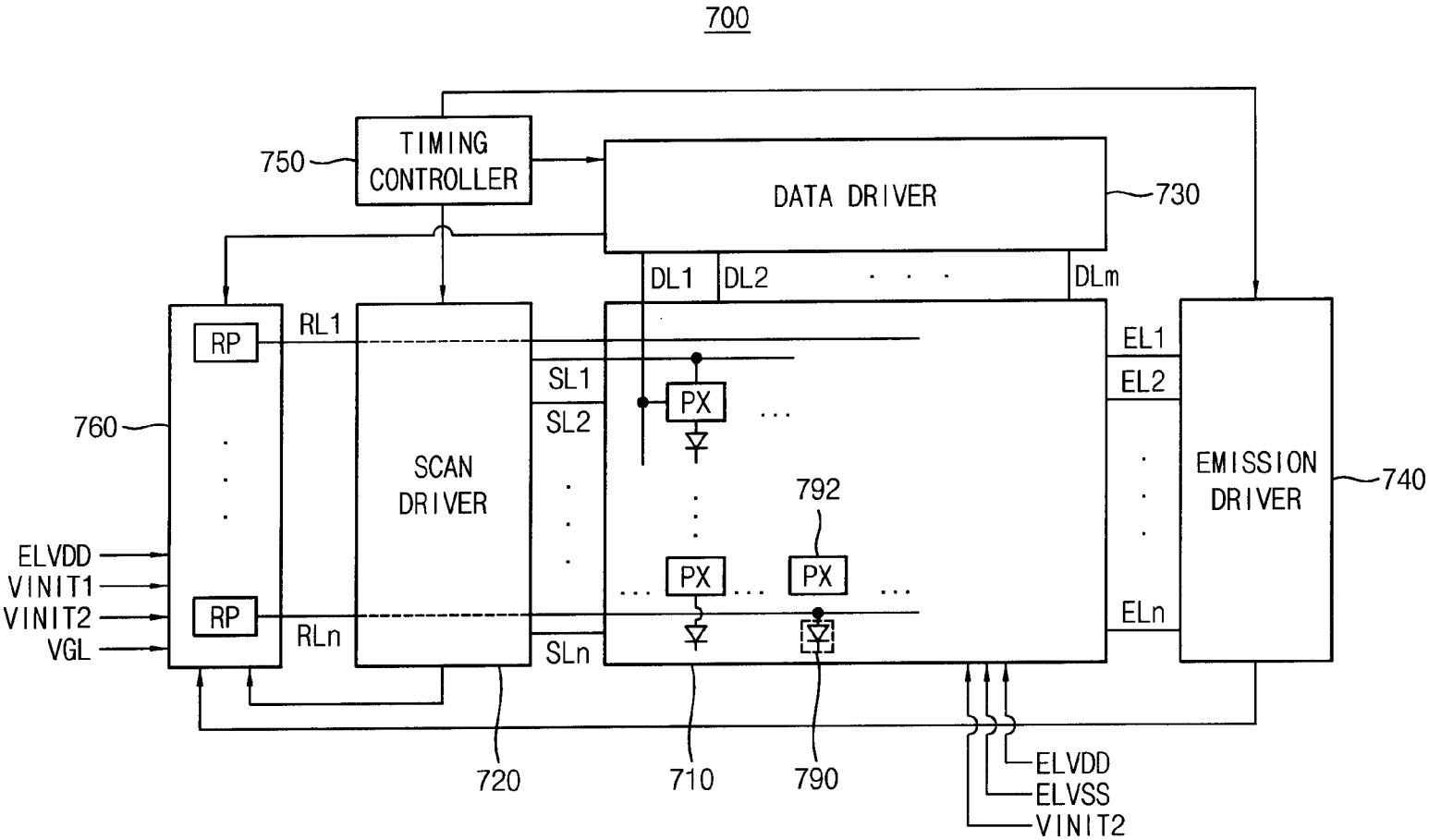
FIG. 7 is a block diagram of an OLED display according to example embodiments.

FIG. 7 is a block diagram of an OLED display according to example embodiments.

Referring to FIGS. 1, 2 and 7, the OLED display 700 includes a display panel 710, a scan driver 720, a data driver 730, an emission driver 740, a timing controller 750, and a dummy pixel circuit 760 having a plurality of pixel repair circuits RP. The OLED display 700 further includes a power supply (not shown).

The display panel 710 includes a plurality of pixel circuits PX each having an OLED, scan lines SL1, SL2, . . . , SLn, emission control lines EL1, EL2, . . . , ELn, and data lines DL1, DL2, . . . , DLm. The scan lines SL1, SL2, . . . , SLn are arranged in a row direction and transmit scan signals. The emission control lines EL1, EL2, . . . , ELn are arranged in the row direction and transmit emission control signals. The data lines DL1, DL2, . . . , DLm are arranged in the column direction and transmit data signals. The display panel 710 further includes a plurality of repair lines RL1, . . . , RLn. In one example embodiment, the repair lines RL1, . . . , RLn are arranged in the row direction and transmit an emission current to one of the OLEDs. As illustrated in FIG. 7, nth repair lines can transmit the emission current to an OLED 790 instead of via a defective pixel circuit 792.

The display panel 710 further includes a plurality of gate initializing lines (not shown) and anode initializing lines (not shown). The gate initializing lines may be arranged along the row direction and transmit gate initializing signals. The anode initializing lines may be arranged in the row direction and transmit anode initializing signals.

The scan driver 720 provides the scan signals to the display panel 710 through the scan lines SL1, SL2, . . . , SLn. The scan driver 720 provides signals corresponding to the scan signals to the pixel repair circuits RP of the dummy pixel circuit 760. The scan driver 720 provides the gate initializing signals to the display panel 710 through the gate initializing lines. The scan driver 720 provides a signal corresponding to the gate initializing signal to the pixel repair circuits RP of the dummy pixel circuit 760. The scan driver 720 provides the anode initializing signal to the display panel 710 through the anode initializing lines.

The data driver 730 provides the data signals to the display panel 710 through the data lines DL1, DL2, . . . , DLm to. The data driver 730 provides a repair data signal corresponding to the data signal to the pixel repair circuits RP of the dummy pixel circuit 760.

The emission driver 740 provides the emission control signals to the display panel 710 through the emission control lines EL1, EL2, . . . , ELn to control the emission of the OLEDs in the pixel circuits PX. The emission driver 740 provides the emission control signals to the pixel repair circuits RP of the dummy pixel circuit 760.

The timing controller 750 controls the drive timings of the scan driver 720, the data driver 730, and the emission driver 740.

The power supply applies a first power supply voltage ELVDD, a second power supply voltage ELVSS, and an initializing voltage VINIT2 to the display panel 710. The level of the first power supply voltage ELVDD may be higher than the level of the second power supply voltage ELVSS. In one example embodiment, the power supply applies the first power supply voltage ELVDD, a repair line initializing voltage VINIT1, the initializing voltage VINIT2, and a direct current voltage VGL to each of the pixel repair circuits RP.

In one example embodiment, each of the pixel repair circuits RP in the dummy pixel circuit 760 includes an emission control unit, a repair line initialization unit, a current mirror unit, a first emission switch, and a second emission switch. The emission control unit controls the emission current provided to the OLED 790 through the repair line based on the scan signal and the repair data signal. The repair line initialization unit initializes the repair line. The repair line initialization unit is connected between the repair line and the emission control unit. The current mirror unit provides a mirror current based on the emission current to the repair line initialization unit. The current mirror unit is connected between a power supply voltage ELVDD and the emission control unit. The first emission switch controls the electrical connection between the emission control unit and the current mirror unit based on the emission control signal. The second emission switch control the electrical connection between the emission control unit and the repair line based on the emission control signal. When a defective pixel circuit 792 is detected, the pixel repair circuit RP provides an emission current to the OLED 790 through a repair line RLn instead of via the defective pixel circuit 792. The defective pixel circuit 790 is disconnected from the OLED 790 by a laser cut, etc.

The pixel repair circuit RP controls a repair line initialization time depend on the value of the mirror current that corresponds to the value of the gray level.

As illustrated in FIG. 2, the current mirror unit includes the first transistor T1 and the second transistor T2. The repair line initialization unit includes the third transistor T3 and the fourth transistor T4. The emission control unit includes the fifth transistor T5 and the driving transistor T6. The first emission switch includes the sixth transistor T6. The second mission switch includes the seventh transistor T7. The pixel repair circuit RP further includes the eighth transistor T8, the ninth transistor T9, and the storage capacitor Cst. In one example embodiment, the repair line initialization unit further includes the hold capacitor. Detailed descriptions of elements, operations and/or constructions substantially the same as or similar to those illustrated with reference to FIGS. 1 through 6 are omitted.

As described above, the OLED display 700 in FIG. 7 includes the pixel repair circuit RP initializing the repair line RL, so that coupling effect, typically generated due to the parasitic capacitors C1 and C2, can be prevented (or canceled). For example, bright spots (or white spots) caused by increasing the emission current IE provided to the OLED 790 can be decreased when the OLED 790 emits light based on low gray levels (e.g., gray level zero to about gray level 30) or low luminance. Thus, the OLED display 700 has a higher display quality.

Figure 8A:
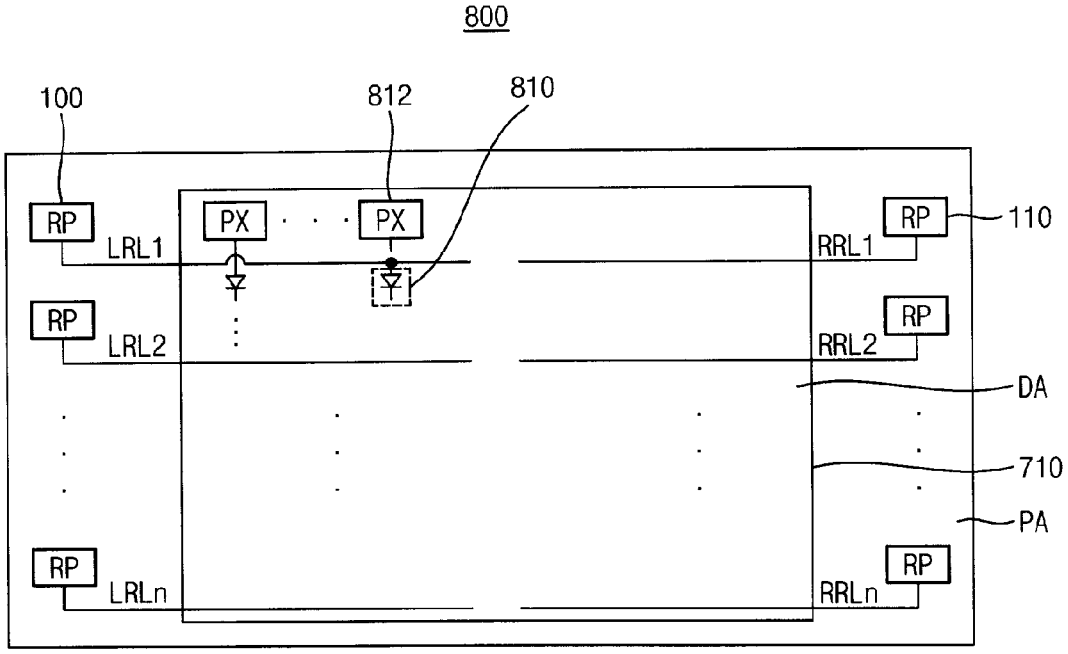
FIG. 8A is a diagram illustrating one example of pixel repair circuits arranged in the OLED display of FIG. 7.

FIG. 8A is a diagram illustrating one example of pixel repair circuits arranged in the OLED display of FIG. 7.

Referring to FIG. 8A, the display panel 710 is located in a display area DA of an OLED display 800. The dummy pixel circuit 760 is located outside of the display panel DA. In other words, a plurality of pixel repair circuits RP are arranged in a non-display area or peripheral area PA that is outside of the display area DA.

In one example embodiment, the pixel repair circuits RP are arranged in the left side and right side of the display panel 710. For example, a pixel repair circuit 100 arranged on the left side of a first row may is connected to a first left repair line LRL1. A pixel repair circuit 110 arranged on the right side of the first row is connected to a first right repair line RRL1. In this embodiment, the pixel repair circuit 100 covers half of the pixel circuits PX that are located in the first row. The pixel repair circuit 110 covers the other half of the pixel circuits PX that are located in the first row. A plurality of left repair lines LRL1, LRL2, . . . , LRLn and a plurality of right repair lines RRL1, RRL2, . . . , RRLn are arranged substantially parallel to the scan lines.

As illustrated in FIG. 8A, the pixel repair circuit 100 provides a normal emission current to an OLED 810 instead of via a defective pixel circuit 812. Since the operations and/or constructions of the pixel repair circuit 100 are described above referred to FIGS. 1 to 6, duplicate descriptions will not be repeated.

Figure 8B:
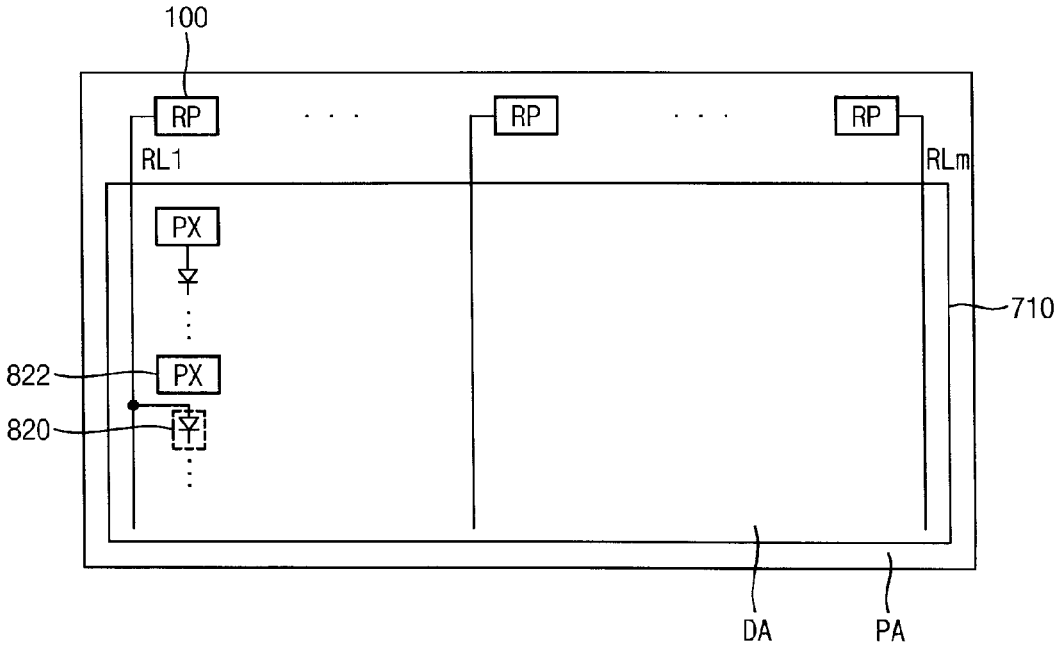
FIG. 8B is a diagram illustrating another example of pixel repair circuits arranged in the OLED display of FIG. 7.

FIG. 8B is a diagram illustrating another example of pixel repair circuits arranged in the OLED display of FIG. 7.

Referring to FIG. 8B, the display panel 710 is located in a display area DA of an OLED display 850. A plurality of pixel repair circuits RP are arranged in a non-display area PA that is outside of the display area DA.

In one example embodiment, the pixel repair circuits RP are arranged on the upper side of the display panel 710. For example, a pixel repair circuit 100 arranged at a first column is connected to a first repair line RL1. The pixel repair circuit 100 covers the pixel circuits PX that are located in the first column. A plurality of repair lines RL1, RL2, . . . , RLm are arranged substantially parallel to the data lines. However, these are examples and the arrangement of the pixel repair circuits and repair lines are not limited thereto.

As illustrated in FIG. 8B, the pixel repair circuit 100 provides a normal emission current to an OLED 820 instead of via a defective pixel circuit 822. Since the operations and/or constructions of the pixel repair circuit 100 are described above referred to FIGS. 1 to 6, duplicate descriptions will not be repeated.

Figure 9:
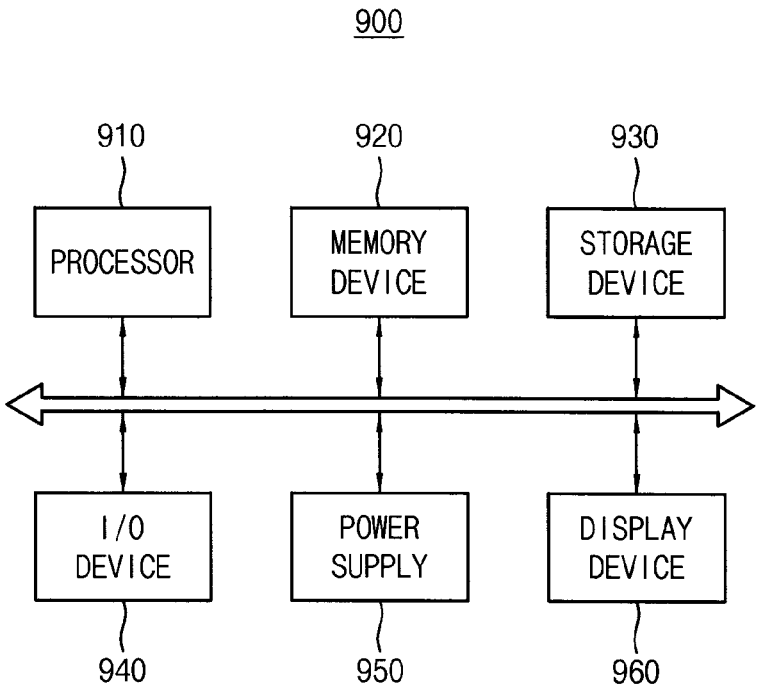
FIG. 9 is a block diagram illustrating an electronic system having an OLED display according to example embodiments.

FIG. 9 is a block diagram illustrating an electronic system having an OLED display according to example embodiments.

Referring to FIG. 9, the electronic system 900 includes a processor 910, a memory device 920, a storage device 930, an input/output (I/O) device 940, a power supply 950, and an OLED display 960. The electronic system 900 further includes a plurality of ports for communicating with a video card, a sound card, a memory card, a universal serial bus (USB) device, and/or other electronic systems. The OLED display 960 corresponds to the OLED display 700 of FIG. 7.

The processor 910 performs various computing functions or tasks. The processor 910 may be, for example, a microprocessor, a central processing unit (CPU), or other processing device or controller. The processor 910 can be connected to other components via an address bus, a control bus, a data bus, etc. Further, the processor 910 can be connected to an extended bus such as a peripheral component interconnection (PCI) bus.

The memory device 920 stores data for the operation of the electronic system 900. For example, the memory device 920 includes at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 930 may be, for example, a solid state drive (SSD) device, a hard disk drive (HDD) device, a CD-ROM device, etc. The I/O device 940 may be, for example, an input device such as a keyboard, a keypad, a mouse, a touch screen, etc., and/or an output device such as a printer, a speaker, etc. The power supply 950 supplies power for the operation of the electronic system 900. The OLED display 960 communicates with other components via the buses or other communication links.

The OLED display 960 includes a display panel 710, a scan driver 720, a data driver 730, an emission driver 740, a timing controller 750, and a dummy pixel circuit 760 having a plurality of pixel repair circuits 100. The OLED display 960 further includes a power supply. In some embodiments, the pixel repair circuit 100 includes an emission control unit 120, a repair line initialization unit 140, a current mirror unit 160, a first emission switch 180*a*, and a second emission switch 180*b*. The pixel repair circuit 100 controls a repair line RL initialization time depend on a value of the mirror current that corresponds to a value of the gray level.

The example embodiments described herein may be applied to any display device and any system including the display device. For example, the example embodiments may be applied to a television, a digital television, a mobile phone, a smart phone, a laptop computer, a tablet computer, a personal digital assistant (PDA), a portable multimedia player (PMP), a digital camera, a music player, a portable game console, a navigation device, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of invention as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The invention is defined by the following claims, with equivalents of the claims to be included therein.

What is claimed is:

1. A pixel repair circuit that provides an emission current to an organic light-emitting diode (OLED) through a repair line, the circuit comprising:

an emission controller configured to control the emission current based on a scan signal and a repair data signal;

a repair line initialization unit configured to initialize the repair line, wherein the repair line initialization unit is connected to a first node between the repair line and the emission controller;

a current mirror unit configured to provide a mirror current of the emission current to the repair line initialization unit, wherein the current mirror unit is connected between a power supply voltage and the emission controller;

a first emission switch configured to control an electrical connection between the emission controller and the current mirror unit based on an emission control signal; and a second emission switch configured to control an electrical connection between the emission controller and the repair line based on the emission control signal.

2. The circuit of claim 1, wherein the current mirror unit includes:

a first transistor including: i) a first terminal connected to the power supply voltage, ii) a second terminal connected to the first emission switch, and iii) a gate terminal connected to the second terminal, wherein the first transistor is configured to provide the emission current to the repair line; and a second transistor including: i) a gate terminal connected to the gate terminal of the first transistor, ii) a first terminal connected to the power supply, voltage, and iii) a second terminal connected to the repair line initialization unit, wherein the second transistor is configured to provide the mirror current to the repair line initialization unit.

3. The circuit of claim 2, wherein the current mirror unit and the emission controller are respectively configured to generate the emission current and the mirror current when the first emission switch and the second emission switch are turned on.

4. The circuit of claim 2, wherein the repair line initializing unit includes:

a third transistor including: i) a gate terminal configured to receive a gate initializing signal, ii) a first terminal configured to receive a direct current (DC) voltage, and iii) a second terminal; and a fourth transistor including: i) a gate terminal connected to the second terminal of the third transistor, ii) a first terminal configured to receive a repair line initializing voltage, and iii) a second terminal connected to the first node.

5. The circuit of claim 4, wherein the third transistor is configured to apply the direct current voltage to the gate terminal of the fourth transistor during a turn-on period of the gate initializing signal and wherein the fourth transistor is configured to initialize the repair line when the fourth transistor is turned on in response to the direct current voltage being applied to the gate terminal of the fourth transistor.

6. The circuit of claim 5, wherein the current mirror unit is further configured to provide the mirror current to the gate terminal of the fourth transistor.

7. The circuit of claim 6, wherein the fourth transistor is configured to be turned off when the mirror current is greater than a threshold.

8. The circuit of claim 5, wherein the repair line initializing unit further includes a hold capacitor connected between the power supply voltage and the gate terminal of the fourth transistor.

9. The circuit of claim 5, wherein the emission controller includes:

a fifth transistor including: i) a gate terminal configured to receive the scan signal and ii) a first terminal configured to receive the repair data signal;

a second node configured to receive a driving voltage; and a driving transistor including: i) a gate terminal connected to the second node, ii) a first terminal connected to the second terminal of the first transistor via the first emission switch, and ii) a second terminal connected to the second emission switch.

10. The circuit of claim 9, wherein the fifth transistor is configured to apply the repair data signal to the first terminal of the driving transistor during a turn-on period of the scan signal.

11. The circuit of claim 10, wherein the driving transistor is configured to provide the emission current to the OLED through the repair line based on the driving voltage applied to the second node.

12. The circuit of claim 9, wherein the first emission switch includes:

a sixth transistor including: i) a gate terminal configured to receive the emission control signal, ii) a first terminal connected to the second terminal of the first transistor, and ii) a second terminal connected to the first terminal of the driving transistor, and wherein the second emission switch includes:

a seventh transistor including: i) a gate terminal configured to receive the emission control signal, ii) a first terminal connected to the second terminal of the driving transistor, and iii) a second terminal connected to the first node.

13. The circuit of claim 12, wherein the sixth transistor is configured to connect the first transistor to the driving transistor during a turn-on period of the emission control signal and wherein the seventh transistor is configured to connect the driving transistor to the repair line during the turn-on period of the emission control signal.

14. The circuit of claim 12, further comprising:

an eighth transistor including: i) a gate terminal configured to receive the scan signal, ii) a first terminal connected to the second terminal of the driving transistor, and iii) a second terminal connected to the second node, wherein the eighth transistor is configured to compensate a threshold voltage of the driving transistor when the eighth transistor is turned on based on the scan signal;

a ninth transistor including: i) a gate terminal configured to receive the gate initializing signal, ii) a first terminal configured to receive an initializing voltage, and iii) a second terminal connected to the second node, wherein the ninth transistor is configured to initialize the gate terminal of the driving transistor when the ninth transistor is turned on based on the gate initializing signal; and a storage capacitor connected between the power supply voltage and the second node.

15. An organic light-emitting diode (OLED) display, comprising:

a display panel including a plurality of pixel circuits each having an OLED;

a dummy pixel circuit located outside of the display panel, wherein the dummy pixel circuit includes a plurality of pixel repair circuits each configured to provide an emission current to a corresponding one of the OLEDs through a corresponding repair line;

a scan driver configured to provide a plurality of scan signals to the pixel circuits and the pixel repair circuits;

a data driver configured to: i) provide a plurality of data signals to the pixel circuits and ii) provide a plurality of repair data signals respectively corresponding to the data signals to the pixel repair circuits;

an emission driver configured to provide an emission control signal to the pixel circuits and the pixel repair circuits; and a timing controller configured to control the scan driver, the data driver, and the emission driver, wherein each of the pixel repair circuits is configured to initialize the repair line based on a repair line initializing voltage.

16. The device of claim 15, wherein each of the pixel repair circuits includes:

an emission controller configured to control the emission current provided to a corresponding one of the OLEDs through the repair line based on the scan signal and the repair data signal;

a repair line initialization unit configured to initialize the repair line based on the repair line initializing voltage, wherein the repair line initialization unit is connected to a first node between the repair line and the emission controller;

a current mirror unit configured to provide a mirror current of the emission current to the repair line initialization unit, wherein the current mirror unit is connected between a power supply voltage and the emission controller;

a first emission switch configured to control an electrical connection between the emission controller and the current mirror unit based on the emission control signal; and a second emission switch configured to control an electrical connection between the emission controller and the repair line based on the emission control signal.

17. The device of claim 16, wherein the current mirror unit includes:

a first transistor including: i) a first terminal connected to the power supply voltage, ii) a second terminal connected to the first emission switch, and iii) a gate terminal connected to the second terminal, wherein the first transistor is configured to provide the emission current to the repair line; and a second transistor including: i) a gate terminal connected to the gate terminal of the first transistor, ii) a first terminal connected to the power supply voltage, and iii) a second terminal connected to the repair line initializing unit, wherein the second transistor is configured to provide the mirror current to the repair line initialization unit.

18. The device of claim 17, wherein the repair line initializing unit includes:

a third transistor including: i) a gate terminal configured to receive a gate initializing signal, ii) a first terminal configured to receive a direct current voltage, and iii) a second terminal; and a fourth transistor including: i) a gate terminal connected to the second terminal of the third transistor, ii) a first terminal configured to receive the repair line initializing voltage, and iii) a second terminal connected to the first node.

19. The device of claim 18, wherein the third transistor is configured to apply the direct current voltage to the gate terminal of the fourth transistor during a turn-on period of the gate initializing signal and wherein the fourth transistor is configured to initialize the repair line while the direct current voltage is applied to the gate terminal of the fourth transistor.

20. The device of claim 19, wherein the current mirror unit is further configured to provide the mirror current to the gate terminal of the fourth transistor.

* * * * *